US005831502A

United States Patent [19]

Kirsch

[11] Patent Number: 5,831,502

[45] Date of Patent: Nov. 3, 1998

[54] RELAY WITH POSITIVELY GUIDED CONTACT SETS

[75] Inventor: Eberhard Kirsch, Wehingen, Germany

[73] Assignee: Hengstler GmbH, Wehingen, Germany

[21] Appl. No.: 890,571

[22] Filed: Jul. 9, 1997

[51] Int. Cl.[6] ..... H01H 67/02

[52] U.S. Cl. ..... 335/129; 335/130

[58] Field of Search ..... 335/78–86, 124, 335/125, 129, 130, 131

[56] References Cited

U.S. PATENT DOCUMENTS 5,053,756 10/1991 Wehrle et al. ..... 335/128
5,568,108 10/1996 Kirsch ..... 335/130

*Primary Examiner*—Lincoln Donovan
*Attorney, Agent, or Firm*—Cooper & Dunham LLP

[57] ABSTRACT

Relay with positively guided contact or contact sets, each contact being accommodated in a chamber and being at least partially separated from the adjacent contacts, and, furthermore, an actuator being provided for respectively opening and closing the contacts, the actuator being of multi-component design. The components of the actuator can be displaced with respect to one another here, the drive not acting on all the components of the actuator.

12 Claims, 3 Drawing Sheets

RELAY WITH POSITIVELY GUIDED CONTACT SETS

The subject matter of the invention is a relay with positively guided contact sets according to the preamble of patent claim 1. Such a relay has been disclosed for example in the patent 28 17 036 C2 from the same applicant.

The subject matter of this patent is that each contact spring is seated in an assigned partial chamber which is sealed off (divided off) from the other contact spring, so that in the event of a fracture in any given contact spring, such spring cannot get into the adjacent chamber and lead to undefined faults there. In this known arrangement, an actuator was proposed which leads the active contact springs in the region of slots which form stop faces corresponding to slot side walls which bear against the respective side of the actuated contact spring, in order to actuate this contact spring by means of bending.

However, for reasons of fabrication, it is disadvantageous to provide the aforesaid, relatively narrow slots in the actuator because the manufacturing costs for such an actuator are thus greatly increased.

In particular, flash and skins are formed during the manufacture of such an actuator using the plastic injection molding method, and this is associated with increased subsequent processing work.

The known actuator according to the applicant's own patent does not, however, fulfill a specific additional requirement. It has in fact proven to be important that in the case of a fault in the region of the contact arrangement (for example if a contact arrangement fuses, for example a normally closed or a normally open element) all the contact arrangements go into the opened state even if one contact arrangement is faulty, for example fused.

There is therefore a general requirement that, in addition to the known function of positive guidance, the contact arrangements likewise open further contacts of the same kind at the transition into the other operational position.

In order to achieve the object which has been set, the invention is defined by the technical teaching of claim 1.

A significant feature of the invention is that a multi-component actuator is now available, the actuator not necessarily having to comprise only two different components which can be displaced in relation to one another. It is also possible to provide more than two components which can be displaced in relation to one another.

These components each form stop faces and form, with these common, assigned stop faces, the respective slot and the associated slot walls of the actuator which actuates the active contact springs.

It is correspondingly sufficient according to the present invention to design a multi-component actuator whose individual components have relatively large slots and which can be manufactured easily using the injection molding method without the risk of the formation of burring or the formation of skin. Nevertheless, owing to the multi-component design of the actuator, the slots are kept very narrow owing to the addition of the other, displaceable component, so that there continues to be positive guidance, as was provided in the older patent 28 17 036.

However, the design of a multi-component actuator also provides the advantage that additional operational reliability is achieved, specifically by virtue of the fact that, in the case of a fault in a contact spring arrangement, the other contact spring arrangements behave in a definite fashion. The definite fashion means here that the transition into the other operational position of the actuator these contact arrangements which have not been faulty open, or respectively do not close.

Therefore, as it were, a neutral state for the contact spring arrangements which have not been faulty is produced, something which was not clearly possible in the case of the older patent 28 17 036.

According to an advantageous refinement of the present invention there is provision for the actuator to comprise at least two components which can be displaced in relation to one another, one part of the actuator being designated a positive guide element while the other part of the actuator is designated a contact actuator.

The two components form slots whose respective widths can be changed with respect to one another, and through which slots the active and the passive contact springs engage.

It is important here for it to be possible to change the slot width of the active contact springs by virtue of a separate displacement of the two actuator components.

Here, the active contact actuator (driven by the armature of the drive system) is displaced by the drive system, while the positive guide element is, as it were, carried along and displaced only by the contact actuator.

The present invention is not restricted to relays which are divided into chambers for the sake of safety, as was described in the old patent 28 17 036, but it is also suitable for all known relays for whose contact arrangements defined states are to be brought about in the event of one of the contact arrangements being faulty or being in a faulty state. It is also not essential to drive the actively driven component of the actuator, namely the contact actuator, at the end face by means of an assigned armature. The drive by means of an armature can be effected anywhere on the contact actuator.

Such a central drive is shown for example in DE 27 28 629 C2, where the armature is approximately in the shape of a C. According to the invention such an armature is then permanently connected to the actively driven contact actuator of the multi-component actuator, in order to move it in the direction of its longitudinal axis.

According to a particular feature of the invention there is provision for the actuation surfaces of the respective active contact spring to be formed with a relatively large surface, the support points on the active contact spring lying relatively far apart and, in the process, dot-shaped or linear support surfaces being, however, formed which are as far apart from one another as possible. This provides the advantage that if the spring executes a swivelling movement owing to its bending, there nevertheless are, and continue to be, definite stop faces or linear faces on this spring.

This is preferably achieved in that the stop faces on the passive positive guide element are of approximately conical design and taper in the direction toward the base of the relay, in order to give rise to a stop face on the respective active contact spring. This ensures that the contact springs bend in a non-damaging way because the support face is matched to the bending line of the contact spring.

An advantage of the present invention is that, by virtue of the multi-component design of the actuator, in which design the components of the actuator define the slot width and can at least be displaced in the region of the slot, the slot is always kept relatively narrow although each actuator component taken by itself has relatively large slot widths, and can therefore be manufactured cost-effectively.

Maintaining narrow slot widths has in fact the advantage that in the case of a spring fracture or in the case of splintering in the region of the contact element, such broken-off components cannot pass downward through the actuator in the direction of the base of the relay and lead to faults in the contact spring assembly.

Thus, the requirements of the safety relay according to DE 28 17 036 C2 are fulfilled, although, according to the present invention, the slot widths required are no longer as narrow as those in the older patent. Furthermore, the subject matter disclosed in this patent 28 17 036 is covered by the present invention.

Of course, the present invention is not restricted to using the actuator for a series of contact arrangements which are arranged lying one inside the other; in another refinement of the invention there is provision for contact arrangements which are located next to one another and are connected in series one behind the other to be actuated with an actuator. Therefore, not only a simple inventive actuator, as illustrated in the following exemplary embodiments, is possible but also an H-shaped one or a multipronged actuator, as is illustrated for example in DE 28 17 036.

In a development of the invention there is provision for a single-component, active contact actuator to be used and for the passive positive guide element to be divided in itself, in order to obtain a two-component positive guide element. This then produces an actuator which is formed from a total of three components.

Conversely, it is likewise possible to use a two-component contact actuator and a single-component positive guide element, as a result of which, in turn, an actuator with a total of three components is likewise formed.

The inventive subject matter of the present innovation results not only from the subject matter of the individual claims but also from the combination of the individual claims with one another.

All the information and features disclosed in the documents, including the abstract and in particular the spatial design illustrated in the drawings, are claimed as essential to the invention insofar as they are new either individually or in combination in comparison with the prior art.

The invention is illustrated in more detail below with reference to drawings illustrating a plurality of ways of embodying the invention. Here, further features and advantages of the invention which are essential to it emerge from the drawings and the description thereof, in said drawings.

Figure 1:
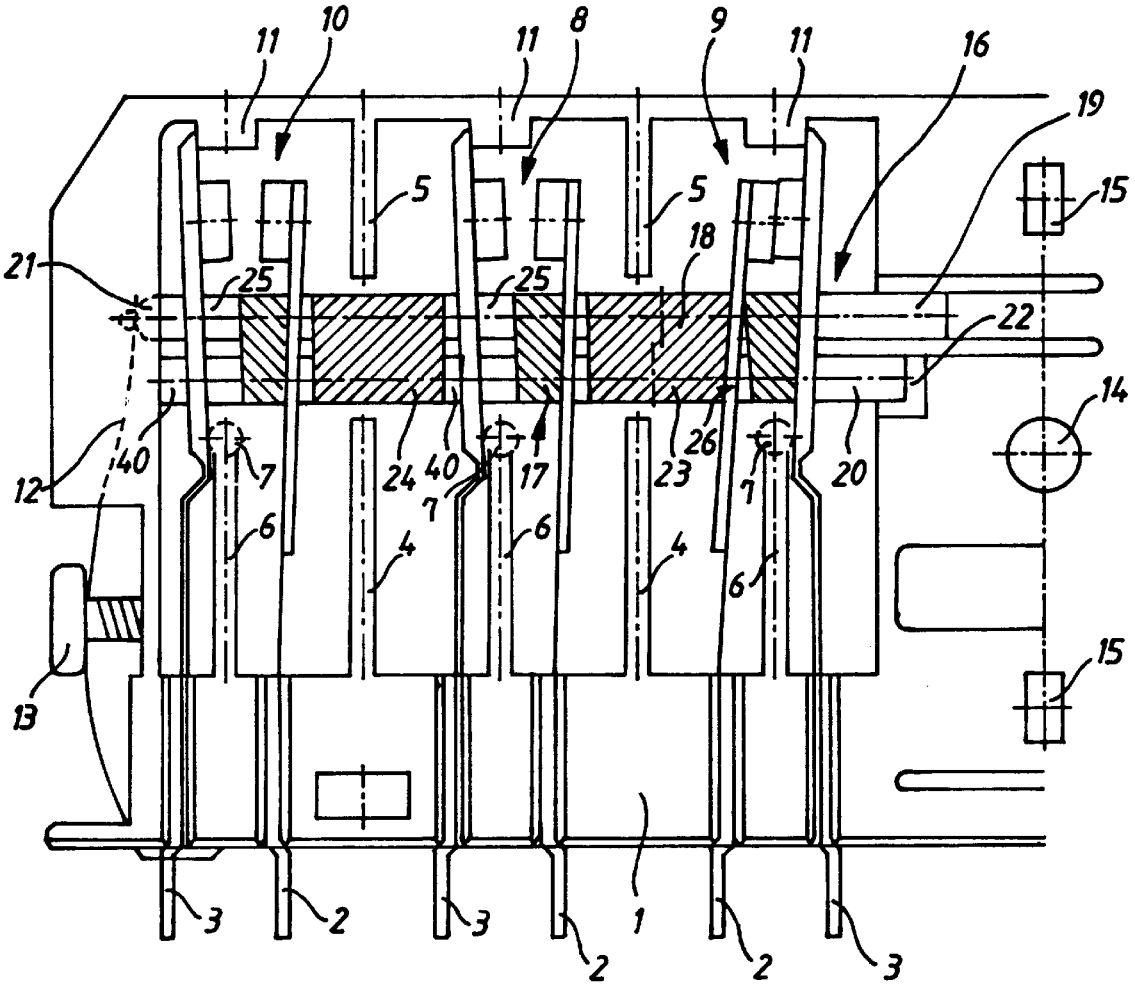
FIG. 1 shows a schematic view of a relay according to the invention in a position of rest.

According to FIG. 1, a plurality of active springs 2 and passive springs 3 are arranged in a spring (1) to form contact arrangements 8, 9, 10. The contact arrangement 8 comprises here a normally open element, a contact arrangement 9 comprising a normally closed element and the contact arrangement 10, comprising in turn a normally open element.

According to the patent 28 17 036, the individual contact springs of each contact arrangement are in separate chambers from one another, which is advantageous for the present invention, but not necessary for the solution.

The respective separation of the contact arrangements 8, 9, 10 is formed by an upper chamber wall 5 and a lower chamber wall 4.

The separation of the individual contact springs of each contact arrangement 8, 9, 10 is formed by an upper support 11, which projects into the upper chamber, and by a lower chamber wall 6, which extends in the direction of the actuator 16.

Upper supports 7, which serve to support the respective passive contact springs 3, are also provided in the region of these chamber walls 6.

A restoring spring 12, whose prestress can be adjusted by means of an adjustment screw 13, is provided on the outside.

A drive system (not illustrated in more detail) which acts on the lug 19 of the actuator 16 is located on the opposite side, only the bearing components of the drive system being illustrated by way of example, these being in fact two latching holes 15 which are spaced apart from one another and between which a bearing hole 14 is arranged. The drive system is anchored in these recesses.

According to the invention, in the exemplary embodiment the actuator 16 is of multi-component design, specifically it comprises a passive positive guide element 17 and an actively driven contact actuator 18.

Figure 2:
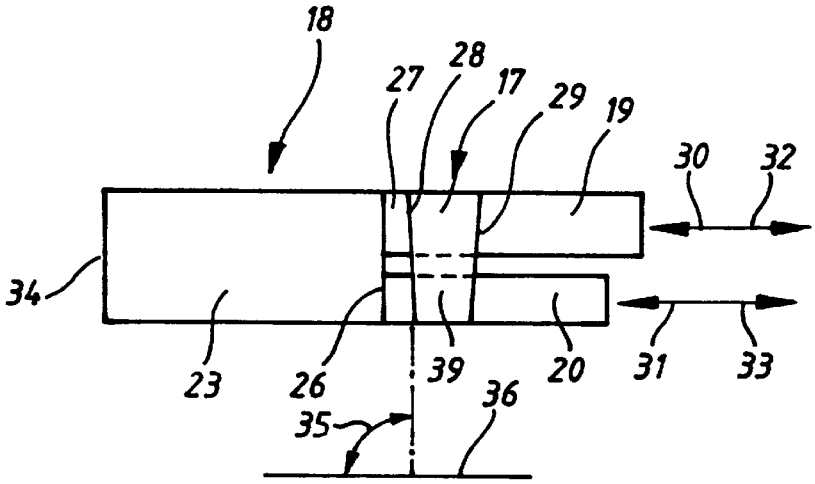
FIG. 2 shows an enlarged partial view of the two-component actuator according to FIG. 1.
Figure 4:
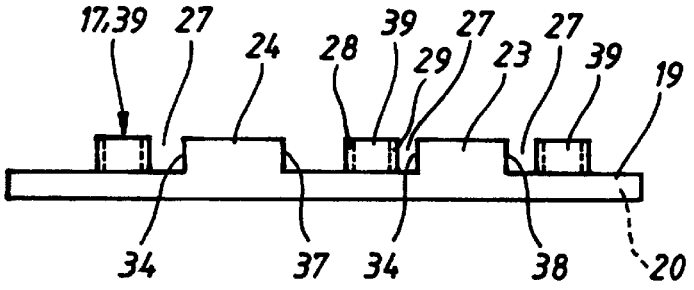
FIG. 4 shows a plan view of the actuator without illustration of the individual springs.

The design of this actuator which is divided in two can be found in FIG. 1, FIG. 2 and FIG. 4.

It is possible to see here that the contact actuator 18 has a lug 19 with which a drive system acts on it in the directions of the arrows 30, 32.

A rod 25, which extends through the relay over its entire length and which is displaceably arranged in the contact set of the relay, is connected to the lug 19 in a materially joined fashion.

On the opposite side, the rod 25 forms a lug 21 against which the free end of the restoring spring 12 bears under spring loading.

As already stated, slide blocks 23, 24 which are arranged spaced apart from one another and which form lateral stop faces 34, 38 and also have side walls 37 are connected to the rod 25.

The contact actuator 18 is therefore essentially of comb-shaped design, the slide blocks 23, 24 protruding laterally from the rod 25 in the plan view.

The dog blocks 39 of the passive positive guide element 17 engage in the intermediate space between the individual slide blocks 23, 24, said positive guide element 17 likewise comprising, according to FIG. 1, a continuous rod 40 which has a front lug 20 with which this positive guide element 17 is displaceably held in a recess 22 in the bracket 1.

The positive guide element 17 is itself not actively driven, but rather carried along by the active springs 2 through corresponding movement of the contact set.

Furthermore, it is also to be noted that the dog blocks 39 of the positive guide element 17 are likewise connected to the rod 40 in a materially joined fashion. However, this is not necessary for the solution; it is possible for there to be provision in both components 17, 18 of the actuator 16 for both the slide blocks 23, 24 and the dog blocks 39 to be made separate from the respective rod 25, 40 and attached thereto with their own attachment means.

It is important that, according to FIG. 2, the two components 17, 18 of the actuator 16 which can be displaced with respect to one another can now each form a slot 27 with a variable slot width.

It is possible to see here that, according to FIG. 2, the slide block 23 forms a right-hand stop face 26 for the spring 2 which engages in the slot, while the dog block 39 of the positive guide element 17 forms a stop face 28 (of conical design).

Here, the stop face 28 is obliquely inclined at an angle 35 with respect to the horizontal 36.

The side face 29, lying opposite the stop face 26, of the dog block 39 does not have any stop function.

Figure 3:
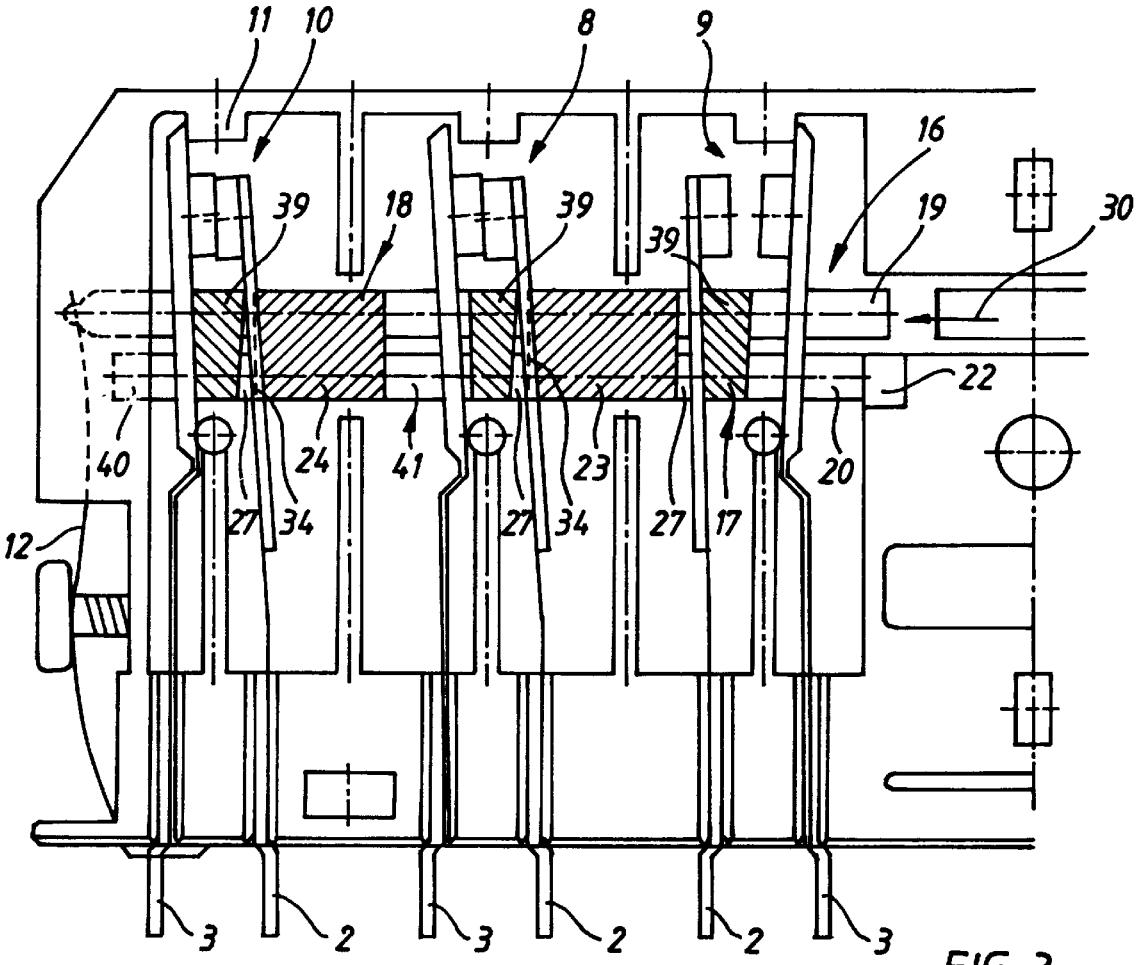
FIG. 3 shows the relay according to FIG. 1 in operation, the left-hand normally open element being burnt off and all the other contact arrangements being in the new state.

If, in accordance with FIG. 3, the contact actuator 18 is now moved to the left with its lug 19 in the direction of the arrow 30, the right-hand stop face 34 of the slide block 23 bears against the active spring 2 in the region of the normally-open-element contact arrangement 8 and bends said spring 2 to the left, so that it makes contact with the passive contact spring 3 of the contact arrangement 8.

The slot 41, in which the respective passive springs 3 engage through the actuator 16, is selected to be of such a width that a favorable degree of play of the respective passive spring 3 is brought about.

At the same time, the left-hand stop face 28 which is of conical design in the contact arrangement 9 bears against the active spring 2 there and bends it away from the passive spring 3, so that this contact arrangement 9 is opened.

It is now possible to see that the contact arrangement 10 which is designed as a normally open element is burnt away, so that when contact is made the passive contact spring 3 no longer lifts off from the upper support 11, in which case, however, the active spring 2 is nevertheless bent to the left as a result of the stop face 34 of the contact actuator 18 (slide block 24) acting on it, and brings about contact.

It is possible to see in the exemplary embodiment according to FIG. 3 that the slot width of the slot 27 is configured to be of an optimum small size, in order to form an optimum positive guidance of the respective active springs 2 by the multi-component actuator 16.

Figure 5:
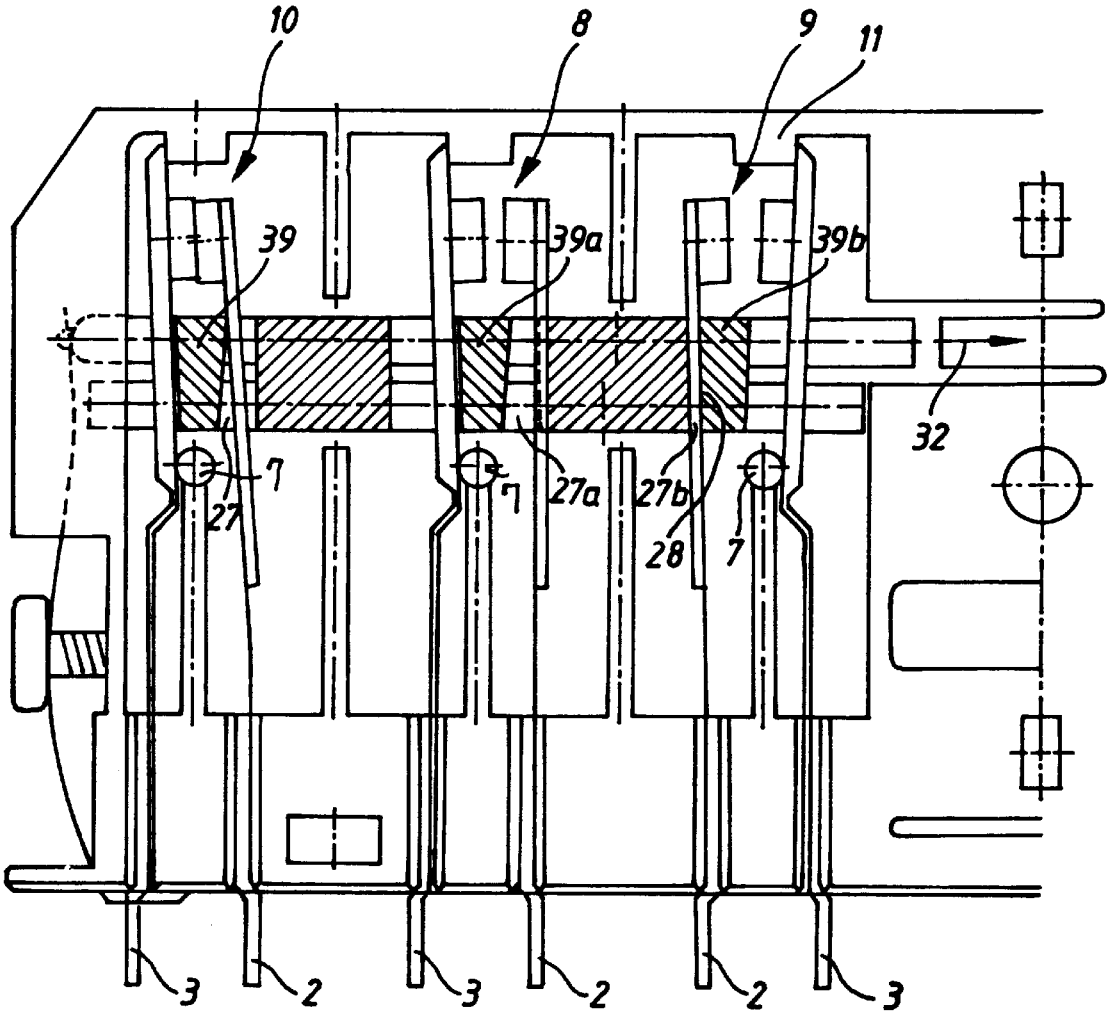
FIG. 5 shows the relay according to FIGS. 1 and 3 in a faulty state—the left-hand, burnt off normally open element being fused and all the other contacts being in the new state.

The case of a fault in a relay according to the invention is now illustrated in FIG. 5. Here, it is assumed that the normally open element of the contact arrangement 10 is fused in the worn-out state.

The contact arrangement 8 (normally open element) is virtually in the new state, as is the contact arrangement 9 (normally closed element).

Under this limiting condition, a certain minimum contact distance must be maintained between the individual contacts of the contact arrangements 8, 9, even if the contact arrangement 10 is faulty.

In the working position according to FIG. 5, an actuation force is exerted on the multi-component actuator 16 in the direction of the arrow 30.

In the exemplary embodiment according to FIG. 5, the force acting in the direction of the arrow 30 (FIG. 2) is now taken away, so that the multi-component actuator 16 has the tendency to move back in the direction of the arrow 32.

In this situation, all the other contacts then have to open or remain open.

This means that the contact arrangement 8 (normally open element) must open while the contact arrangement 9 (normally closed element) must maintain the open state. This is achieved according to the invention in that the positive guide element 17 now begins to operate. This is achieved in that the dog block 39 bears against the active spring 3 of the contact arrangement 10.

It is important here that the contact arrangement 8 is not impeded by the aforesaid multi-component design of the actuator. That is to say no positive guidance takes place in this region of the contact arrangement 8, but this contact is opened by the prestress which is present in the active spring 2 because the slot 28 now opens according to the invention and at the same time the contact actuator 18 moves to the right in the direction of the arrow 32.

The positive guidance between the contact arrangement 10, which influences the contact arrangement 9 before the definition of the positive guidance, is now important.

Here, the active spring 2 of the contact arrangement 9 (normally closed element) actually bears against the assigned stop face 28 of the dog block **39*b* and holds this spring in the open position, whereas the passive spring remains uninfluenced on its support 11 and the support 7**.

It thus becomes clear that a variable slot width of the slots 27 is assigned to the multi-component actuator.

According to FIG. 5, the left-hand slot 27 is opened, while the central slot **27*a* is partially opened and the right-hand slot 27*b*** is closed.

When the force on the contact actuator 18, which moves in the direction of the arrow 32, is removed, the positive guide element 17 also starts to move in the direction of the arrow 33 and moves a small distance.

The play of the positive guide element 17 is in fact only of such a magnitude while the fused, passive contact spring 3 continues to be carried along in the contact arrangement 10.

However, if the passive contact spring 3 in the contact arrangement 10 is not carried along at all, the positive guide element 17 also has an approximately zero movement.

That is to say it remains essentially stationary.

As a result of the multi-component actuator 16 shown, a positive guidance between the normally closed element 9 and the normally open element 10 is therefore produced.

If the contact arrangement 10 in the exemplary embodiment according to FIG. 5 were, for example, not fused, but rather, by way of example, the contact arrangement 8, an appropriate situation would result, i.e. the dog block **39*a* then bears with its right-hand stop face against the active contact spring 2 and therefore prevents the active contact spring 2 of the adjacent contact arrangement 9 from executing a further closing movement, therefore keeping this active contact spring 2** in its open state.

The entire actuator 16 acts here like a movable wall which penetrates the contact spring assembly of the relay, in order thus to separate off the upper part of all the contact springs from the lower part of the contact springs.

If, for example, the active spring 2 of the contact arrangement 9 were now to fracture in the region of its clamping-in point in the actuator 16 (the actuation face is arranged here in the lower region of the contact actuator 18 in the region of the slide block 23), the spring would fracture in this region and, owing to the narrow slot **27*b*, the upper part of the broken-off spring would be prevented from dropping down through the narrow slot 27*b*** into the chamber.

However, at the same time a fault in the upper chamber region of the relay is prevented, because if the broken-off, upper partial element of the active spring 2 slips upward out of the slot, a fault is avoided in all circumstances, owing to the fact that undesired contact can no longer be made here either.

I claim:

1. A relay comprising:

a plurality of positively guided contact spring sets, each contact spring set being at least partially separated from an adjacent contact spring set; and an actuator for respectively opening and closing each contact spring set, the actuator comprising a plurality of sections which are displaced in relation to and spaced apart from one another and form slots of variable width through which contact springs extend for controlling bending of the contact springs in response to actuation.

2. The relay as claimed in claim 1, wherein the plurality of sections which are displaced in relation to one another include dog blocks, slide blocks, and stop faces forming the slots of variable width that control bending of the contact springs.

3. The relay as claimed in claim 2, wherein the dog blocks and the slide blocks are displaced relative to each other forming the slots of variable width that control bending of the contact springs.

4. The relay as claimed in claim 3, wherein the slots between the dog blocks, slide blocks, and stop faces have widths which differ from one another depending on the relative position of the sections of the actuator.

5. The relay as claimed in any of claims 1 through 4, wherein the stop face on one of the plurality of sections of the actuator is conical and tapers towards the base of the relay.

6. The relay as claimed in claim 1, further comprising active springs which displace at least one section of the actuator.

7. The relay as claimed in claim 1, further comprising an active contact actuator section and a driver for acting upon the active contact actuator section.

8. The relay as claimed in claims 7 and 7, further comprising a passive guide element, the slide blocks being located in the passive guide element, the slide blocks being carried by the movement of the active spring.

9. The relay as claimed in claim 1, wherein the actuator is a rod.

10. The relay as claimed in claim 1, wherein the actuator is H-shaped.

11. The relay as claimed in claim 1, wherein the actuator is multi-pronged.

12. The relay as claimed in claim 1, whereby in case of a fault, a neutral state exists, and non-faulty contact spring sets remain open.

* * * * *